US010058136B2

(12) United States Patent
Mountfort

(10) Patent No.: US 10,058,136 B2
(45) Date of Patent: Aug. 28, 2018

(54) MITTENS WITH STRETCHABLE CUFF

(76) Inventor: Anna-Maria Mountfort, Toronto (CA)

( * ) Notice: Subject to any disclaimer, the term of this patent is extended or adjusted under 35 U.S.C. 154(b) by 328 days.

(21) Appl. No.: 12/851,022

(22) Filed: Aug. 5, 2010

(65) Prior Publication Data

US 2012/0030853 A1 Feb. 9, 2012

(51) Int. Cl.
*A41D 19/01* (2006.01)
*A41D 19/00* (2006.01)

(52) U.S. Cl.
CPC ..... *A41D 19/01* (2013.01); *A41D 19/0044* (2013.01)

(58) Field of Classification Search
CPC ..... A41D 13/08; A41D 19/01; A41D 19/00; A41D 19/04; A41D 19/02; A41D 2/00; A41D 19/0044; A41D 19/0089
USPC ..... 2/158, 159, 162, 167, 170
See application file for complete search history.

(56) References Cited

U.S. PATENT DOCUMENTS 4,843,653 A * 7/1989 Coble ..... 2/170
5,361,415 A 11/1994 Deering et al.
6,363,534 B1 4/2002 Clough
2009/0100561 A1* 4/2009 Holmes ..... 2/16
2010/0186139 A1* 7/2010 Kurtz ..... 2/158

OTHER PUBLICATIONS

"Seam." Merriam-Webster. Merriam-Webster, n.d. Web. Apr. 5, 2016. <http://www.merriam-webster.com/dictionary/seam>.*

* cited by examiner

*Primary Examiner* — Sally Haden
(74) *Attorney, Agent, or Firm* — Norton Rose Fulbright Canada LLP

(57) ABSTRACT

A pair of mittens is disclosed that is adapted to be worn by a child to protect at least the child's hands and wrists from adverse winter conditions. Each mitten of the pair includes a hand-receiving mitten portion for covering the child's hand, and an elastically extendable cuff fastened to an aft end of the mitten portion. The elastically extendable cuff has a circumferentially uninterrupted tubular body and an elastic band disposed at an aft end of the cuff. The elastic band circumscribes an opening at the aft end through which the child's hand is received. The elastically extendable cuff is at least longitudinally seamless such that the elastically extendable cuff is both longitudinally and circumferentially stretchable from an un-stretched configuration to a stretched configuration.

20 Claims, 4 Drawing Sheets

MITTENS WITH STRETCHABLE CUFF

TECHNICAL FIELD

The present application relates to hand garments and, more particularly, to mittens for children.

BACKGROUND OF THE ART

It is desirable for many parents to provide mittens to their children in order to protect their hands from the cold or from other adverse conditions. However, many mittens may be easily removed by children or may fall off during use, which is clearly undesirable. Moreover, the cuff portion of many mittens is insufficiently long and may lead to an unprotected area located between the child's jacket and the child's mittens.

While attempts have been made to address such issues with mittens, problems nevertheless remain with the known solutions brought about to date. For example, U.S. Pat. No. 6,363,534 discloses a mitten to which an elongated snow shielding sleeve is attached, the snow shielding sleeve having a length extending up to an elbow of a child. In addition, the child's overcoat sleeve can pass over the snow shielding sleeve of the mitten, such as to attempt to provide additional coverage and protection for the wrist of the child. However, such mittens have been found to insufficiently durable and too reliant on the consumer to use in a limited manner. The design of the snow shielding sleeve disclosed in U.S. Pat. No. 6,363,534 has been found to be insufficiently stretchable and fails to remain in place on the child's forearm. With normal and repeated wear, the snow shielding sleeve described in U.S. Pat. No. 6,363,534 have been found to lose their shape and elasticity, which compromises their use and effectiveness.

Additionally, the snow shielding sleeves taught in U.S. Pat. No. 6,363,534 are said to be made of an elastic rib knit fabric, which is generally stretchable only circumferentially, but not longitudinally. Accordingly, this snow shielding sleeve is able to circumferentially stretch to accommodate different sized wrists and forearms, but cannot stretch and expand longitudinally, which would provide improved coverage and further help keep both the sleeve and the mitten in position. Moreover, snow shielding sleeves of the type described in U.S. Pat. No. 6,363,534 have been found to be disadvantageous for a number of reasons, including their inability to appropriately stay in position on the child's arm during us (i.e. it tends to fall down, thereby exposing the forearm and wrists), as well as their inability to withstand the normal wear and tear to which garments of this type are exposed during a winter season of continuous wear by children. For example, such snow shielding sleeves of the prior art have been found to be unable to sustain the normal, continued and/or repeated use of users wearing the mittens hundreds of times in a single season. As such, these snow shielding sleeves can only be worn when covered by a coat sleeve, which helps to keep them up and maintain them in place on the child's forearm, as they otherwise tend to stretch and fall down when exposed to the elements and to repeated on-off use. Such snow shielding sleeves would not be suitable for use without a long sleeved overcoat at least partially protecting them during use, and thus would not, for example, be suitable for use with a sleeveless vest.

Therefore, an improved mitten is sought.

SUMMARY OF THE INVENTION

In accordance with one aspect of the present application, there is provided a pair of mittens adapted to be worn by a child to protect at least the child's hands and wrists from adverse winter conditions, each mitten of the pair of mittens comprising: a hand-receiving mitten portion for covering the child's hand; and an elastically extendable cuff fastened to an aft end of the mitten portion, the elastically extendable cuff having a circumferentially uninterrupted tubular body and an elastic band disposed at an aft end thereof, the elastic band circumscribing an opening at the aft end of the elastically extendable cuff through which the child's hand is adapted to be received, the elastically extendable cuff being at least longitudinally seamless such that the elastically extendable cuff is both longitudinally and circumferentially stretchable from an un-stretched configuration to a stretched configuration.

In accordance with another aspect of the present application, there is provided a garment for covering at least a hand or foot of a wearer to provide protection from adverse winter weather conditions, the garment comprising a hand or foot receiving portion and an elongated elastically extendable cuff extending therefrom, the elastically extendable cuff being adapted to cover at least a portion of the wearer's arm or leg and having a circumferentially uninterrupted tubular body extending between the hand or foot receiving portion and a elasticized double welt circumscribing an opening at an aft end of the elastically extendable cuff, the elastically extendable cuff being at least longitudinally seamless, and wherein the elastically extendable cuff is at least longitudinally stretchable from an un-stretched configuration to a stretched configuration, wherein a length of the elastically extendable cuff in said stretched configuration is substantially greater than that in the un-stretched configuration.

There is further provided, in accordance with another aspect of the present invention, a method for protecting at least the hands and wrists of a child from adverse winter weather conditions, the method comprising: providing a pair of mittens, each having a mitten portion and an elongated elastically extendable cuff extending therefrom, the elastically extendable cuff having a circumferentially uninterrupted and seamless tubular body extending between the mitten portion and an elasticized double welt circumscribing an opening at an aft end of the elastically extendable cuff; and putting the mittens onto the child, by: inserting the child's hands into the opening in the aft end of the elastically extendable cuff, and passing the hands and wrists of the child through the elastically extendable cuff until at least the hands are positioned within the mitten portion of the mittens; and stretching the elastically extendable cuff, from an un-stretched position to a stretched position, by stretching the elastically extendable cuff longitudinally away from the mitten portion until the elastically extendable cuff extends a desired length up the child's arm, the desired length being greater than a length of the elastically extendable cuff in the un-stretched position.

In accordance with another aspect, there is provided a pair of mittens adapted to be worn by a child to protect at least the child's hands and wrists from adverse winter conditions, each mitten of the pair of mittens comprising: a hand-receiving mitten portion for covering the child's hand, the mitten portion being composed of a first material; and an elastically extendable cuff connected to the mitten portion and being composed of a second material different from the first material, the elastically extendable cuff being fastened to an aft end of the mitten portion at a transversely extending joint interconnecting the mitten portion and the elastically extendable cuff, the transversely extending joint adapted to be generally aligned with a wrist of the child, the elastically extendable cuff having a circumferentially uninterrupted tubular body and an elastic band disposed at an aft end thereof, the elastic band circumscribing an opening at the aft end of the elastically extendable cuff through which the child's hand is adapted to be received, the elastically extendable cuff being at least longitudinally seamless such that the elastically extendable cuff is both longitudinally and circumferentially stretchable from an un-stretched configuration to a stretched configuration.

In accordance with another aspect, there is provided a garment for covering at least a hand or foot of a wearer to provide protection from adverse winter weather conditions, the garment comprising a hand or foot receiving portion composed of a first material and an elongated elastically extendable cuff extending therefrom, the elastically extendable cuff being connected to the hand or foot receiving portion and being composed of a second material different from the first material, the elastically extendable cuff being fastened to an aft end of the hand or foot receiving portion at a transversely extending joint interconnecting the hand or foot receiving portion and the elastically extendable cuff, the elastically extendable cuff being adapted to cover at least a portion of the wearer's arm or leg and having a circumferentially uninterrupted tubular body extending between the hand or foot receiving portion and a elasticized double welt circumscribing an opening at an aft end of the elastically extendable cuff, the elastically extendable cuff being at least longitudinally seamless, and wherein the elastically extendable cuff is at least longitudinally stretchable from an un-stretched configuration to a stretched configuration, wherein a length of the elastically extendable cuff in said stretched configuration is substantially greater than that in the un-stretched configuration.

DETAILED DESCRIPTION

Figure 1:
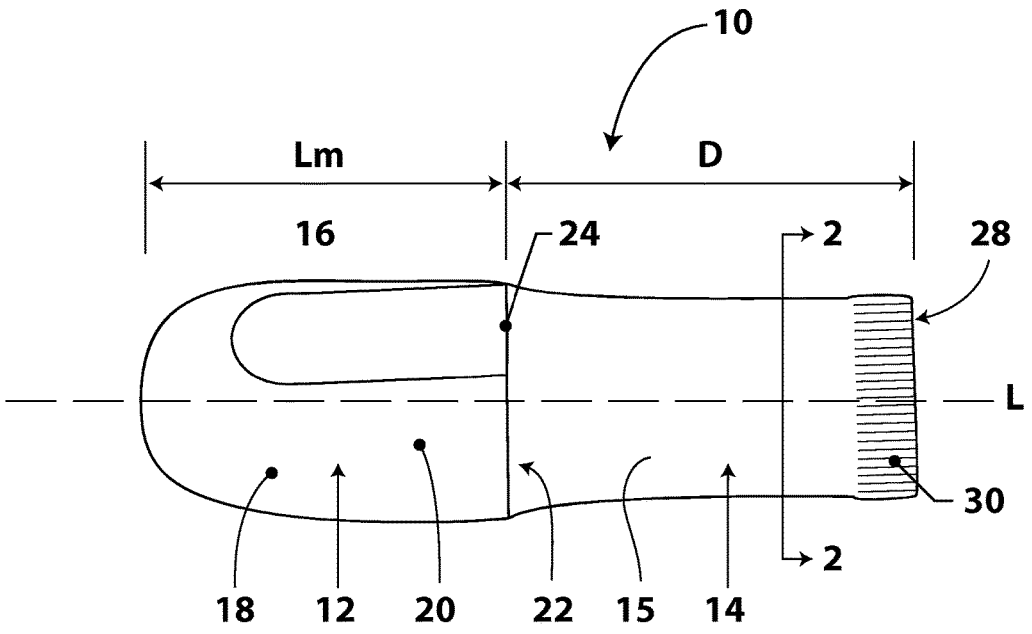
FIG. 1 is an elevated view of a mitten in accordance with one embodiment of the present application.

Referring to FIG. 1, a mitten in accordance with one particular embodiment of the present application is generally illustrated at 10. The mitten 10 includes a mitten portion 12 in which a child's hand may be inserted for shielding/protecting the hand, and a stretchable cuff 14 which is connected to the mitten portion 12 and which circumscribes the child's arm for increased protection of at least the child's wrist and forearm from snow and other adverse weather conditions. The stretchable cuff 14 also particularly aids in maintaining the mitten 10 securing in place on the child, as will be seen.

The mitten portion 12 includes a thumb pocket 16 in which a child may insert his or her thumb and a finger pocket 18, in which the child may insert his or her fingers.

The stretchable cuff 14 has a tubular body 15 that is connected at an inner end thereof to an aft end 22 of the mitten portion 12, and which thereby forms a tubular extension of the mitten portion 12 which extends a given un-stretched length or distance D (see FIG. 1) away from the mitten portion 12 relative to the longitudinal axis L, and thus over the child's wrist and up their forearm. As noted below, this tubular construction of the body 15 is such that it is at least at least longitudinally seamless. The stretchable cuff 14 may be connected to the mitten portion 12 using various means known in the art, for example, knitting, sewing, etc. In the embodiment shown, the stretchable cuff 14 is connected to the mitten portion 12 at a seam 24, which extends about the full circumference of the opening formed in the aft end 22 of the mitten portion 12. The stretchable cuff 14 of the present mitten 10 is preferably made of a thin elastic material, which provides good elastic deflection (i.e. stretch) in both the circumferential or radial directions and in the longitudinal direction (i.e. parallel to the longitudinal axis L).

Figure 3:
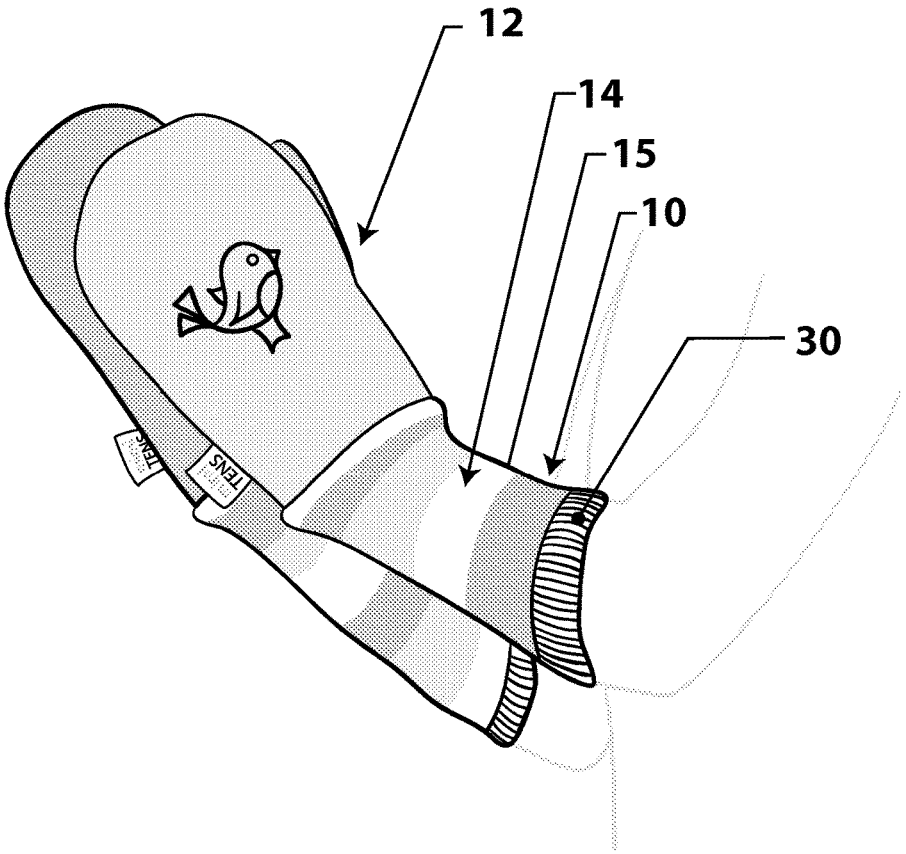
FIG. 3 is a perspective view of the mittens of the present application shown on a child's arm, the stretchable cuff of the mittens being disposed in an un-stretched configuration.
Figure 4:
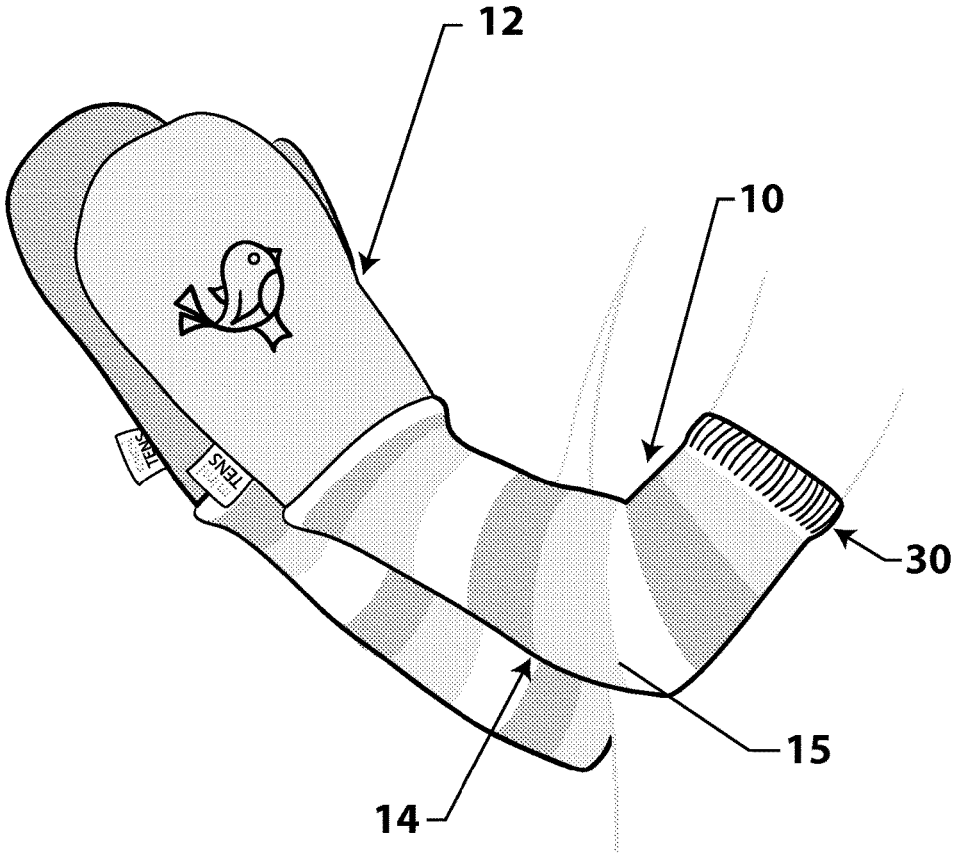
FIG. 4 is a perspective view of the mittens of the present application shown on a child's arm, the stretchable cuff of the mittens being disposed in a stretched configuration.

A particular feature of the stretchable cuff 14 is its improved ability to stretch longitudinally, parallel to the longitudinal axis L, far more than the cuffs of known prior art mittens. Particularly, the elastic cuff 14 of the present mitten 10 may be extended from a substantially un-stretched configuration, as shown in FIG. 3 for example, to a stretched configuration, as shown in FIG. 4 for example. As seen, the stretched configuration of the cuff 14 has a longitudinal length that is substantially greater than that of the un-stretched length, such as, for example, to permit the cuff 14 to cover the child's entire forearm and extend over the elbow and up to the upper arm of the child (as seen in FIG. 4). In one particular embodiment, the stretched length of the cuff may be up to 2D, i.e. twice as long as the un-stretched length D of the cuff 14. The elastic material of the stretchable cuff 14 also similarly permits circumferential and/or radial stretch with a corresponding ratio. For example, the fully stretched width (in a plane substantially perpendicular to the longitudinal axis L) of the seamless tubular body 15 of the cuff 14 is, in one particular embodiment, at least twice the width of the same cuff when in an un-stretched position (as shown in FIG. 1). This allows for ease of installation, and helps to hold the stretchable cuff 14 in place on the child's arm, while being able to accommodate differently-sized zed arms.

In one particular embodiment, referring back to FIG. 1, the un-stretched distance or length D of the stretchable cuff 14 is also greater than the length Lm of the mitten portion 12, relative to the longitudinal axis L. More particularly, while it is to be understood that other possible relative lengths and/or ratios are possible, in one possible exemplary embodiment the longitudinal length Lm of the mitten portion 12 is approximately 5 inches while the un-stretched length D of the stretchable cuff 14 is approximately 6.5 inches, thereby providing a ration of un-stretched cuff length to mitten portion length (D/LM) of approximately 1.3.

The stretchable cuff 14 further includes, at an aft end 28 thereof, a circular elastic band 30, which is sometimes found in certain socks and is referred to as a "double welt". This elasticized double welt 30, which includes the elastic band, extends continuously about the full circumference of the aft end 28, thereby circumscribing the opening though which the child's hand is inserted to put the mitten on. The elastic band 30 is chosen to have an un-stretched circumference that is generally slightly smaller than that of the child's arm, such that the circular elastic band 30 is stretched open during the installation of the mitten 10, but then closes inward such as to engage the child's forearm and thus elastically secure the stretchable cuff 14 onto the child's arm, and thereby retain the entire mitten 10 in place on the child. As noted in further detail below, the double welt 30 at the aft end 28 of the stretchable cuff 14 also provides additional advantages, such as the ability to include stitching and/or printing thereof, in order to provide sizing and/or branding information for example.

Accordingly, in addition to the elastic material from which the seamless tubular body 15 of the stretchable cuff 14 is made, the elastic band 30 at the outermost or aft end 28 of the cuff 14 provides added means for retaining the mitten 10 securing in position on the child's arm during use. Moreover, the elastic band 30 helps support the elastic material of the stretchable cuff 14 in holding the mitten 10 on the child's arm, when the stretchable cuff is in a stretched configuration. This is particularly helpful when the stretched length of the cuff is sufficient to extend up to the child's upper arm, as seen in FIG. 4. Consequently, the durability of the stretchable cuff 14, and so of the mitten 10, is increased by providing an elastic band 30 in the stretchable cuff 14. Without the elastic band 30, the cuff 14 would be more prone to wear and to loss of its resilient and elastic properties, as well as being far more prone to being slid down the arm towards the mitten portion 10 during use. The elastic band 30 of the cuff 14 thus maintains the cuff in position thereby reducing the chances that the child's wrists will become exposed, a particular problem which occurs when using the known cuffed-mittens of the prior art.

The stretchable cuff 14 is also thin enough that a sleeve of an overcoat may easily be positioned over the stretchable cuff 14. As such, a child wearing the mitten 10 having the stretchable cuff 14 may easily put on an overcoat after having the mittens in place on their hands, with a sleeve of the overcoat covering at least a substantial portion of the stretchable cuff 14 of the mitten 10. In addition, even when the stretchable cuff 14 is not stretched, i.e. is in an un-stretched configuration as seen in FIG. 3, the elastic band 30 of the cuff 14 may be spaced away from the mitten portion 12 at different distances thereof, such that the stretchable cuff 14 covers different lengths of a child's arm. Additionally, even in this un-stretched position, the elastic band 30 helps retain the cuff in place on the forearm, thereby preventing unwanted "ridding down" of the cuff during use.

In one particular embodiment, the seam 24 interconnecting the mitten portion 12 and the stretchable cuff 14 may be aligned with a wrist of the child. In another embodiment, the seam 24 need not be aligned with the wrist of a child, and the mitten portion 12 may extend over a portion of the child's wrist such as to improve the cold-weather protection thereof.

Figure 2:
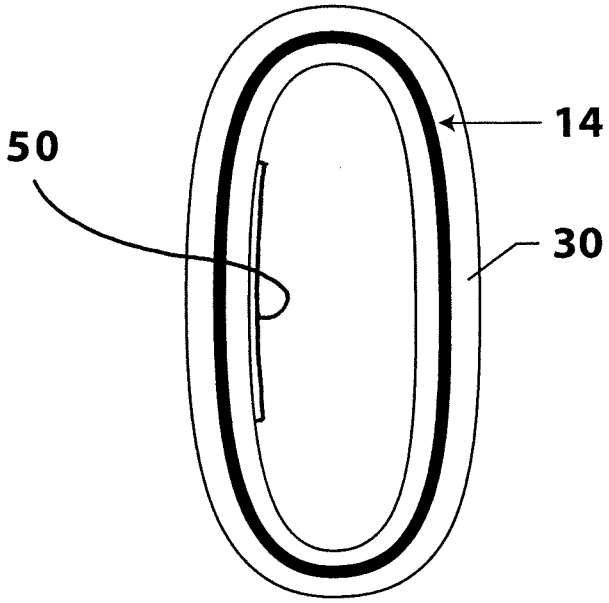
FIG. 2 is a cross-section view taken through the line 2-2 of FIG. 1.

Referring to FIG. 2, the stretchable cuff 14 of the present mitten 10 has a tubular construction and therefore is at least longitudinally seamless, i.e. it does not include a longitudinally extending seam along any portion of the length thereof. In other words, as seen in FIG. 2, the seamless tubular body 15 of the cuff 14 is integrally formed in a circumferentially uninterrupted tubular manner such as to be devoid of any join or seam extending longitudinally (i.e. in the direction of the longitudinal axis L). The elastic seamless tubular body 15 of the cuff 14 is thus circumferentially continuous and uninterrupted, unlike certain known mitten cuffs of the prior art which are formed by folding over a material sheet and stitching the longitudinal edges together thereby creating a longitudinally extending seam the complete length of the cuff. Such longitudinal seams are undesirable because, in addition to other more aesthetic reasons, such longitudinal seams generally significantly restrict the amount the cuff can stretch in the longitudinal direction. As such, in a particular embodiment of the present mitten 10, the stretchable cuff 14 thereof is seamless longitudinally, which enhances the elastic ability thereof of the cuff to stretch in a longitudinal direction.

The stretchable cuff 14 may be made from various elastic materials and/or combinations of materials. In one exemplary embodiment, the seamless tubular body 15 of the stretchable cuff 14 is made entirely of cotton with spandex (such as Lycra™) knit therein. The elastic band 30 may be made of any suitable flexible elastic material, and is retained in place within a folded-over end of the seamless tubular body 15.

When the stretchable cuff 14 is extended without being stretched, i.e. is in an un-stretched configuration as shown in FIG. 3, the elastic material from which the stretchable cuff 14 is made is sufficient to hold the stretchable cuff 14 in place on the child's arm. However, when the stretchable cuff 14 is stretched, i.e. is in a stretched configuration as shown in FIG. 4, the elastic band 30 provides further support for retaining and holding the stretchable cuff 14 in place on the child's arm, and prevents the stretchable cuff 14 from returning to its original, un-stretched length, i.e. from returning to an un-stretched configuration.

In one particular embodiment, the stretchable cuff 14 of the mitten 10, when disposed in an un-stretched configuration (as shown in FIG. 1, for example), has a length D equal to at least a portion of the length of a child's forearm, however has a maximum length equal to the complete length of a child's forearm. When disposed in a stretched configuration, the cuff 14 may have a length which is greater than the length of the forearm of a child, such that the stretchable cuff 14 extends beyond the elbow of the child and along an upper portion of the child's arm. In another embodiment, even in a stretched configuration, the stretchable cuff 14 has a length which is less than or equal to the length of the forearm of a child. As such, the elastic band 30 of the stretchable cuff 14 may circumscribe a forearm of the child or alternatively, an upper portion of the arm of the child.

In use, a hand of a child is inserted into the opening formed at the aft end 28 of the stretchable cuff 14 of the mitten 10 and through the hollow center of the seamless tubular cuff 14 until such time as the hand is within the mitten portion 12 thereof. The hand of the child may then be comfortably positioned inside the mitten portion 12, with the thumb of the child's hand being located inside the thumb pocket 16 and a remainder of the child's hand being positioned inside the finger pocket 18, at which point the stretchable cuff 14 will circumscribe and thus cover the child's wrists and at least the a portion of the child's forearm. It is understood that the stretchable cuff 14 may stretch circumferentially as required in order to accommodate the child's arm therein. The stretchable cuff 14 may then be pulled away from the mitten portion 12 such as to stretch the cuff 14 from its un-stretched configuration to a stretched configuration whereby the elastic band 30 is spaced further away from the mitten portion 12 than it is in the un-stretched configuration. The cuff may be stretched until the stretchable cuff extends a desired length along the child's arm. The elastic band 30 may then be released so that it encloses radially onto the child's arm, thereby securing the cuff 14, and therefore the mitten 10, in place thereto. If necessary, the stretchable cuff 14 may be stretched longitudinally in order to circumscribe a larger portion of the child's arm. Afterwards, an overcoat or jacket may be worn by the child, an arm portion of the jacket covering at least a substantial portion of the stretchable cuff 14.

As such, an improved mitten 10 for a child is provided which can protect or shield the child's hand from the cold or from other adverse conditions. The stretchable cuff 14 prevents a child from easily removing the mitten 10. While the thin and stretchable cuff 14 may be extended along the child's arm such that a portion thereof is covered by an overcoat, i.e. wherein the cuff is worn beneath the overcoat sleeve which thus covers at least a portion of the stretchable cuff, the stretchable cuff is equally able to be stretched sufficiently wide to be able to fit overtop of such an overcoat sleeve. Alternately still, the nature of the stretchable cuff 14 as described herein is able to cover most (i.e. a majority of) the wearer's arm, and as such the mittens 10 are particularly well suited to be worn with sleeveless vests, such as a down vest, which have become popular outerwear garments. According, when worn with a sleeveless vest, the stretchable cuffs 14 of the mittens 10 cover most of the wearer's arm and thus act as a sleeve which can be pulled up or pulled down as required, in order to keep the wearer's arm warm and protected from the elements. With all of these possible uses, the nature of the stretchable cuff 14 helps maintain the garment in place, such that the risk that a child loses his or her mittens and exposes his or her hands, wrists, forearms, etc. to any adverse winter conditions, is greatly reduced.

The mitten 10, due to the stretchable nature of the cuff 14, may be extended to various different lengths in order to cover various portions of a child's arm, or so as to be adapted to different lengths of a child's arm as a child grows, or alternatively to accommodate differently-sized children. If desired, the mitten 10 may even be stretched beyond an elbow of the child such that the elastic band 30 of the mitten 10 circumscribes an upper portion of the child's arm. Additionally, the elastic band 30 ensures that even when the mitten 10 is stretched longitudinally to cover more of a child's arm, in a stretched configuration, the elastic band 30 firmly holds the mitten 10 in place thereon, until the elastic band 30 is released, i.e. is pulled away from the child's arm, at which point the stretchable cuff 14 of the mitten 10 may re-assume its original length.

In one embodiment, the mitten portion 12 may include an inner layer made of an insulating material, and an outer layer 20 which covers the inner layer, and which is made of a water-resistant material. As such, the outer layer 20 of the mitten portion 12 (made of a water-resistant material) is composed of a material which is different than the material of the stretchable cuff 14 (composed of a cotton with spandex knit therein, as noted above in paragraph).

As noted above, the stretchable cuff 14 includes a double welt 30 at the aft end 28 thereof, which includes the circular elastic band therein. In addition to helping to retain the cuff in place, the double welt also provides additional advantages in the form of a location on the cuff which can be stitched, printed or otherwise marked in order to including printing, logos or other indicia thereon.

This accordingly permits the double welt 30 to have sizing and/or branding information thereon. For example, the outer surface of the double welt band may include indicia 50, including for example the brand or trademark under which the product is sold thereon, and the specific size (Small, Medium, Large, etc.) on its inner circumferential surface. These may be applied via stitching directly into the material of the stretchable cuff at the double welt location, or alternately printed or applied thereon in a suitable manner. This is a particularly useful advantage, given that it means a separate, and potentially unsightly, tag need not necessarily be applied to the cuff and/or mitten at another location, given that both the brand, garment size and/or any other necessary information ("made in:" location, for example) can be provided directly on the double welt 30 of the stretchable cuff 14 of the mittens.

The above description is meant to be exemplary only, and one skilled in the art will recognize that changes may be made to the embodiments described without departing from the scope of the invention disclosed. For example, although a mitten is referred to herein, it is to be understood that a glove (i.e. having separate, individual pockets for fingers, may also be provided with the stretchable cuff as described herein. Further, although generally described with respect to a mitten or glove for covering a hand and wrist of a wearer, it is to be understood that the garment described herein could also be used as a foot and ankle covering, i.e. as a sock, shoe, slipper, etc, whereby a foot covering portion corresponds to the hand covering mitten portion described above and a stretchable ankle/leg covering portion is attached thereto which correspond to the stretchable cuff described herein. In this manner, the stretchable cuff becomes a sock and/or legging. Still other modifications which fall within the scope of the present invention will be apparent to those skilled in the art, in light of a review of this disclosure, and such modifications are intended to fall within the appended claims.

The invention claimed is:

1. A pair of mittens adapted to be worn by a child and adapted to protect at least the child's hands and wrists from adverse winter conditions, each mitten of the pair of mittens comprising:

a hand-receiving mitten portion adapted to cover the child's hand, the mitten portion being composed of a first, water-resistant material; and an elastically extendable cuff connected to the mitten portion and being composed of a second, elastic material different from the first material of the first, water-resistant material, the elastically extendable cuff being fastened to an aft end of the mitten portion at a transversely extending seam interconnecting the mitten portion and the elastically extendable cuff, the elastically extendable cuff having a circumferentially uninterrupted tubular body and a double welt disposed at an aft end of the elastically extendable cuff, the double welt circumscribing an opening at the aft end of the elastically extendable cuff through which the child's hand is adapted to be received, the double welt having an outer circumferential surface facing radially outwardly and an inner circumferential surface facing radially inwardly, the elastically extendable cuff is both longitudinally and circumferentially stretchable from an un-stretched configuration to a stretched configuration.

2. The mittens as defined in claim 1, wherein, when the elastically extendable cuff is in the stretched configuration, the double welt radially constricts to hold the cuff in place, and prevents the cuff from returning prematurely to the un-stretched configuration.

3. The mittens as defined in claim 1, wherein the tubular body of the elastically extendable cuff is at least longitudinally seamless.

4. The mittens as defined in claim 1, wherein the elastically extendable cuff has a cuff length in the stretched configuration that is at least two times greater than the cuff length in the un-stretched configuration.

5. The mittens as defined in claim 1, wherein the elastically extendable cuff is adapted to cover a portion of a forearm of the child when disposed in the un-stretched configuration, and the elastically extendable cuff is adapted to cover at least a longitudinally greater portion of the forearm of the child when disposed in the stretched configuration.

6. The mittens as defined in claim 5, wherein the elastically extendable cuff is adapted to extend to a portion of the child's arm above the elbow when disposed in the stretched configuration.

7. The mittens as defined in claim 1, wherein the elastically extendable cuff, in the un-stretched configuration, has an un-stretched cuff length, the un-stretched cuff length being adapted to be equal to at least a portion of the length of the child's forearm, and a maximum length of the un-stretched cuff length being adapted to be not greater than the entire length of the child's forearm.

8. The mittens as defined in claim 7, wherein the elastically extendable cuff has a stretched cuff length which is adapted to be at least equal to a major portion of the length of the child's forearm, a maximum length of the stretched cuff length being adapted to be greater than the length of a child's forearm, when disposed in the stretched configuration.

9. The mittens as defined in claim 1, wherein the elastically extendable cuff has a stretched cuff length adapted to be greater than a major portion of the child's entire arm, the stretchable cuff forming a sleeve in the stretched configuration.

10. The mittens as defined in claim 1, wherein the second material of the tubular body comprises cotton having spandex knit therein.

11. The mittens as defined in claim 1, wherein the double welt has indicia thereon including at least one of sizing information and a brand name.

12. The mittens as defined in claim 1, wherein the inner circumferential surface of the double welt has indicia thereon.

13. A garment adapted to cover at least a hand or foot of a wearer to provide protection from adverse winter weather conditions, the garment comprising: a hand or foot receiving portion composed of a first, water-resistant material and an elongated elastically extendable cuff extending therefrom, the elastically extendable cuff being connected to the hand or foot receiving portion and being composed of a second, elastic material being different from the first, water-resistant material, the elastically extendable cuff being fastened to an aft end of the hand or foot receiving portion at a transversely extending seam interconnecting the hand or foot receiving portion and the elastically extendable cuff, the elastically extendable cuff being adapted to cover at least a portion of the wearer's arm or leg and having a circumferentially uninterrupted tubular body extending between the hand or foot receiving portion and an elasticized double welt circumscribing an opening at an aft end of the elastically extendable cuff, the elasticized double welt having an outer circumferential surface facing radially outwardly and an inner circumferential surface facing radially inwardly, and wherein the elastically extendable cuff is at least longitudinally stretchable from an un-stretched configuration to a stretched configuration, wherein a length of the elastically extendable cuff in said stretched configuration is substantially greater than the length of the elastically extendable cuff in the un-stretched configuration.

14. The garment as defined in claim 13, wherein the tubular body of the elastically extendable cuff is at least longitudinally seamless.

15. The garment as defined in claim 13, wherein the elastically extendable cuff has a cuff length in the stretched configuration that is at least two times greater than the cuff length in the un-stretched configuration.

16. The garment as defined in claim 13, wherein, when the elastically extendable cuff is in the stretched configuration, the elasticized double welt radially constricts to hold the elastically extendable cuff in place, and prevents the cuff from returning prematurely to the un-stretched configuration.

17. The garment as defined in claim 13, wherein the stretchable cuff has a stretched cuff length, the stretched cuff length being adapted to be greater than a major portion of the wearer's entire arm, the stretchable cuff forming a sleeve when in the stretched configuration.

18. The garment as defined in claim 13, wherein the double welt has indicia thereon, the indicia comprising at least one of sizing information and a brand name.

19. The garment as defined in claim 13, wherein the second, elastic material of the tubular body comprises cotton having spandex knit therein.

20. The garment as defined in claim 13, wherein the inner circumferential surface of the double welt has indicia thereon.

* * * * *